United States Patent [19]

Nakajima et al.

[11] 4,173,203

[45] Nov. 6, 1979

[54] ENGINE SYSTEM

[75] Inventors: Yasuo Nakajima, Yokosuka; Michio Onoda, Yokohama; Kunihiko Sugihara, Tokyo; Shinichi Nagumo, Yokohoma, all of Japan

[73] Assignee: Nissan Motor Co., Ltd., Yokohama, Japan

[21] Appl. No.: 856,532

[22] Filed: Dec. 1, 1977

[30] Foreign Application Priority Data

Dec. 2, 1976 [JP] Japan ..... 51-145124

[51] Int. Cl.[2] ..... F02M 25/06

[52] U.S. Cl. ..... 123/119 A; 123/75 B; 123/76

[58] Field of Search ..... 123/119 A, 76, 75 B

[56] References Cited

U.S. PATENT DOCUMENTS

| | | | |
|---|---|---|---|
| 3,046,961 | 7/1962 | Dolza | 123/76 |
| 3,182,645 | 5/1965 | Wilson | 123/76 |
| 3,363,612 | 1/1968 | Brennere | 123/76 |
| 4,020,808 | 5/1977 | Yagi | 123/119 A |
| 4,022,175 | 5/1977 | LaPrade et al. | 123/119 A |
| 4,041,910 | 8/1977 | Houseman | 123/119 A |

FOREIGN PATENT DOCUMENTS

| | | | |
|---|---|---|---|
| 2456160 | 5/1975 | Fed. Rep. of Germany | 123/119 A |
| 2611806 | 9/1976 | Fed. Rep. of Germany | 123/119 A |

*Primary Examiner*—Wendell E. Burns

*Attorney, Agent, or Firm*—Schwartz, Jeffery, Schwaab, Mack, Blumenthal & Koch

[57] ABSTRACT

Disclosed herein is an engine system which comprises an internal combustion engine, an air admission system to admit scavenging air, under pressure, into an engine cylinder through an additional intake valve and an EGR system. The air admission system includes an air pump and an EGR conduit of the EGR system having an inlet end connected to the engine exhaust conduit and an outlet end connected to the air admission system upstream of the air pump to effect admission of recirculated exhaust gas through the additional intake valve together with scavenging air. With this EGR system and the replacement of residual gas with scavenging air, the rate of exhaust gas in the engine cylinder upon ignition is kept substantially constant over varying partial loads.

4 Claims, 6 Drawing Figures

ENGINE SYSTEM

BACKGROUND OF THE INVENTION

This invention relates to an engine system including an internal combustion engine and an exhaust gas recirculation (EGR) system.

It is recognized that, in the conventional engine, a portion of exhaust gas tends to remain in each cylinder when the exhaust stroke has terminated and the amount of such residual gas will increase under partial load conditions, causing unstable engine operation under these conditions. Thus, if the residual gas is expelled from the cylinder and replaced with the same amount of scavenging air, the admission of more fuel to the cylinder is possible because more fuel can be burned with the help of the scavenging air, thus permitting the engine power output to increase when power is demanded. Fuel consumption can be reduced under partial load conditions if the residual gas is replaced with the same amount of scavenging air because the probability of misfiring under these conditions is decreased significantly.

PRIOR ART

It has been proposed, for the purpose of preventing knocking, to admit air, under pressure, into the cylinder during the end portion of the compression stroke to keep the charge in the cylinder cool and again during the end portion of the exhaust stroke to cool the exhaust valve and spark plug. The problem resides in that high charging pressure, i.e., pressure above 10 kg/cm$^2$, is necessary for the admission of air into the cylinder during the end portion of the compression stroke.

It has also been proposed, for the purpose of expelling the residual gas from the cylinder, to admit air, under pressure, into the cylinder during the exhaust stroke.

It has also been proposed, for facilitating oxidation of HC and CO contents of the exhaust gas, to admit air, under pressure, into the cylinder during the end portion of the expansion stroke and the exhaust stroke.

It has been proposed that an air fuel mixture be inducted into the cylinder through an intake valve to swirl around the cylinder axis in one direction and that air be admitted under atmospheric pressure through an air inlet valve during the beginning portion of the intake stroke to swirl around the cylinder axis in the opposite direction to produce a stratified charge comprising an ignitable cloud in the proximity of a spark plug.

It has been proposed that an air fuel mixture be inducted into the cylinder through an intake valve during the intake stroke and that air be admitted under atmospheric pressure through an air inlet valve to swirl around the cylinder axis to produce a stratified charge comprising an ignitable cloud in the proximity of a spark plug and to accomplish fast combustion of the charge in the cylinder.

It has been proposed that an air fuel mixture be inducted into the cylinder through an intake valve to swirl around the cylinder axis and that air, in a jet form, be admitted under atmospheric pressure through an air inlet valve all through the intake stroke to swirl within a plane substantially parallel to the cylinder axis to accomplish fast combustion. The jet of air is directed toward the electrode of the spark plug to scavenge the same.

SUMMARY OF THE INVENTION

It is recognized that the total of the amount of residual gas and of exhaust gas recirculated disposed within the cylinder will have a significant and direct effect on the suppression of NOx formation and the engine driveability and thus must receive attention in tailoring an EGR system to an internal combustion engine.

The invention results from this recognition and it is therefore an object of the invention to provide an engine system in which the rate or proportion of exhaust gas in the cylinder is always kept appropriate so as to suppress NOx formation sufficiently without impairing the engine stability.

It is another object of the invention to provide an engine system in which, with simple construction and arrangement, the amount of recirculated exhaust gas is varied in proportion to the exhaust pressure, i.e., the pressure in the engine exhaust conduit.

It is another object of the invention to provide an engine system in which exhaust gas recirculation (EGR) is effected without causing carbon deposit on the inner surface of the engine intake system.

According to an engine system of the invention, the admission of air from a source of pressurized air into the cylinder is effected by means of an additional intake or air inlet valve during a period overlapping the exhaust and intake strokes to forcibly expel residual gas from the cylinder and an EGR conduit connects the engine exhaust conduit to an upstream portion of the source of pressurized air so as to cause exhaust gas to flow through the EGR conduit due to difference between pressure at the inlet and outlet ends of the EGR conduit, i.e., this pressure varying with variations of the exhaust pressure, toward the air inlet valve for admission into the cylinder with the air.

BRIEF DESCRIPTION OF THE DRAWINGS

The invention will be further described hereinafter in connection with the accompanying drawings, in which.

DESCRIPTION OF THE PREFERRED EMBODIMENT

Figure 1:
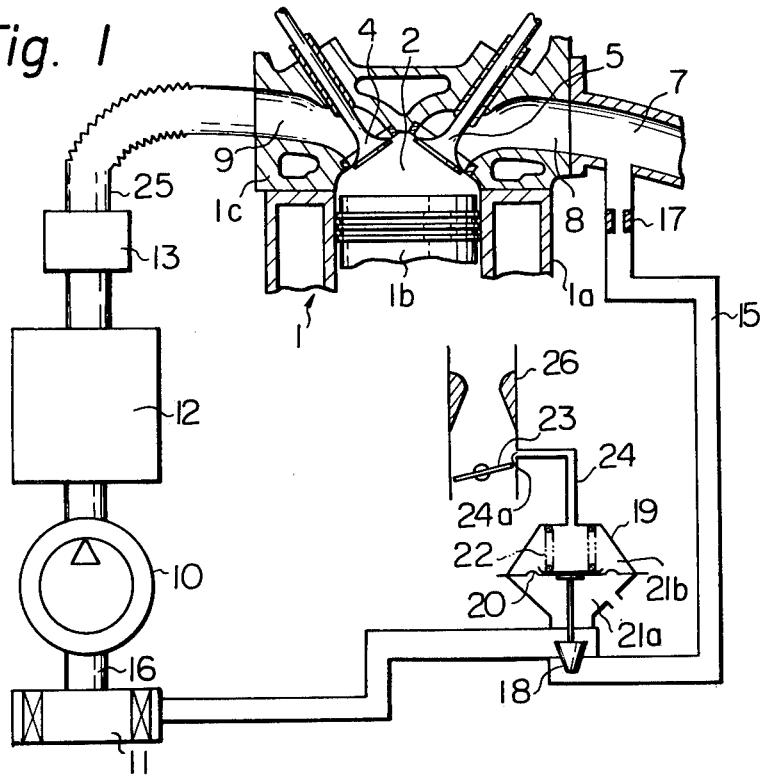
FIG. 1 is a schematic view of an engine system of the invention.
Figure 2:
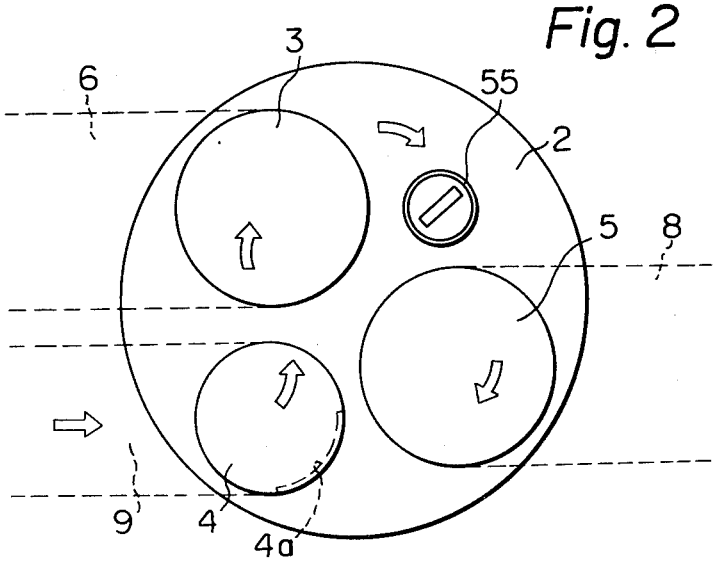
FIG. 2 is a top plan view of a valve arrangement of the internal combustion engine shown in FIG. 1.

Referring to FIGS. 1 and 2 of the accompanying drawings, an internal combustion engine 1 comprises a cylinder block 1*a* formed with at least one cylinder, a piston 1*b* slidably disposed in the cylinder for reciprocal movement therein and a cylinder head 1*c* secured to the cylinder block to close the cylinder. The cylinder block 1*a*, piston 1*b* and cylinder head 1*c* cooperate to form a combustion chamber 2.

The cylinder head 1*c* has an intake port bore 6 (see FIG. 2), an exhaust port bore 8 and an additional intake port bore 9 all opening to the combustion chamber 2, and supports an intake valve 3 (see FIG. 2) to close the intake port bore 6, an exhaust valve 5 to close the exhaust port bore 8 and an additional intake or air inlet valve 4 to close the additional intake port bore 9. The heads of the three valves 3, 4 and 5 are arranged as shown in FIG. 2.

A carburetor 26 is connected to provide an air fuel mixture to the intake port bore 6 and an exhaust conduit 7 is connected to the exhaust port bore 8 to receive exhaust gas resulting from the combustion within the combustion chamber 2. Additional intake port bore 9 is connected to the outlet of a surge tank 12 through a conduit 25. An air pump 10, which is driven by the engine crankshaft in timed relationship with the engine r.p.m., transfers air, under pressure above atmospheric pressure, toward additional intake port bore 9 through surge tank 12. Atmospheric air is drawn by air pump 10 through an air cleaner 11 and a conduit 16. Flow rate of fluid passing through conduit 25 is controlled by a flow control device 13.

An exhaust gas recirculation (EGR) conduit 15 has an inlet end connected to exhaust conduit 7 to receive exhaust gas and has an outlet end connected to air cleaner 11 at its atmospheric or dirty side. If desired the outlet end of EGR conduit 15 may be connected to conduit 16 connecting a discharge or clean side of air cleaner 11 to a suction port of air pump 10. In this case, it is preferable to provide the EGR conduit with a filter.

An operation mode control (OMC) valve 18 is fluidly disposed in EGR conduit 15 and has an open position in which EGR conduit 15 is opened and a closed position in which EGR conduit 15 is fully closed. A motor 19, in the form of a vacuum servo, is mounted on EGR conduit 15 and has a diaphragm 20 to which the control valve is fixed through a valve stem. Vacuum servo 19 has an atmospheric chamber 21*a* and a vacuum chamber 21*b* below and above diaphragm 20, respectively, and a spring 22 mounted within vacuum chamber 21*b* to bias the OMC valve 18 toward the illustrated closed position (see FIG. 1). A vacuum conduit 24 connects a port 24*a* opening to the air induction passage of carburetor 26 to vacuum chamber 21*b* to apply vacuum at port 24*a* to vacuum chamber 21*b* causing diaphragm 20 to move the OMC valve 18 toward the open position against the bias action of spring 22. Port 24*a* is positioned on the atmosphere or upstream side of a throttle valve 23 when it is at the idle speed position but is positioned on the vacuum or downstream side of throttle valve 23 when it is open. Thus, vacuum adjacement atmospheric pressure is transmitted to the vacuum chamber under idle and full load conditions, while, under part load conditions, vacuum great enough to urge the OMC valve 18 to the open position is transmitted to vacuum chamber 21. Spring 22 is set so that the OMC valve 18 is kept in the open position under partial load conditions.

A solenoid device may be used to operate the OMC valve 18, if desired, replacing vacuum servo 19.

In this case, a switch sensitive to the opening degree of the carburetor throttle valve is used and is electrically connected with the solenoid device to cause the solenoid device to lock the OMC valve in the open position under partial load conditions only.

A flow control orifice 17 is fluidly disposed in EGR conduit 15 intermediate the OMC valve 18 and exhaust conduit 7. It will be noted that the flow rate of exhaust gas passing through EGR conduit 15 is a function of the cross section of flow control orifice 15 and the difference between pressures at the upstream and downstream sides of the orifice 17.

In order to vary the flow rate of exhaust gas passing through EGR conduit 15 strictly in proportion to the pressure within exhaust conduit 7, the flow resistance through the OMC valve 18 as it is open must be sufficiently smaller than the flow resistance at flow control orifice 17 so that, when the OMC valve 18 is open, the difference between pressures at the upstream and downstream sides of the control orifice may be substantially equal to the difference between the pressure within exhaust conduit 7 and the pressure adjacement the outlet end of the EGR conduit. It will be noted that because the size of flow control orifice 17 is fixed and the pressure adjacement the outlet end of EGR conduit 15 is kept constant, i.e., atmospheric pressure, exhaust gas passing through the EGR conduit will vary in proportion to the exhaust pressure within the exhaust conduit. It will now be appreciated that with this EGR system the amount of recirculated exhaust gas can be precisely controlled in proportion to the amount of charge in combustion chamber 2 because the exhaust pressure represents the amount of charge. If desired, another EGR system having another type of EGR valve may be employed.

Figure 3:
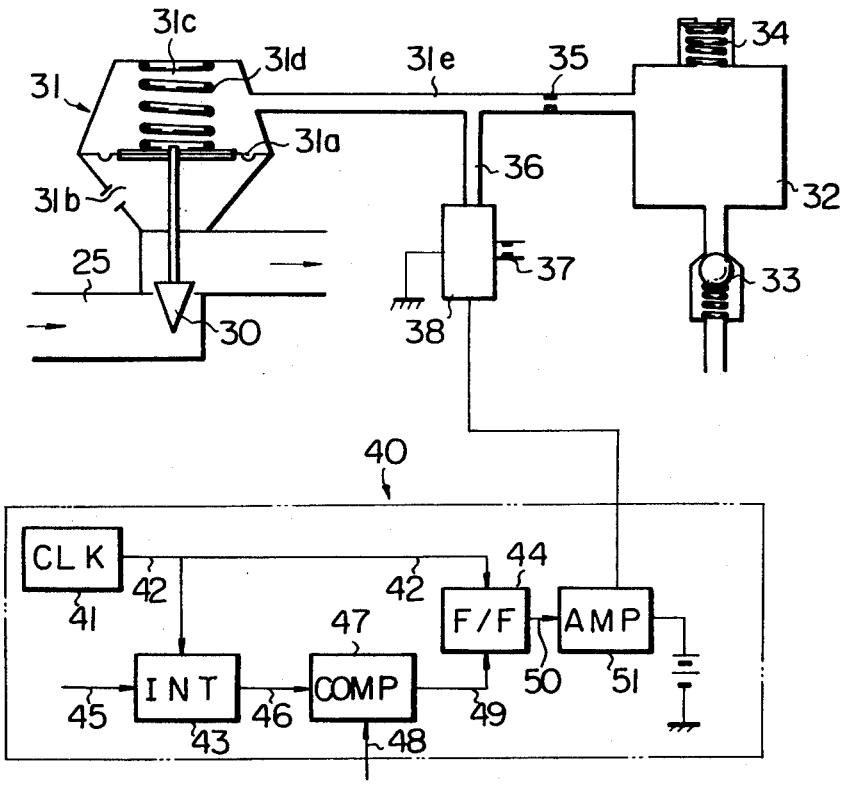
FIG. 3 is a diagrammatic view of the flow control device shown in FIG. 1.
Figures 4A, 4B:
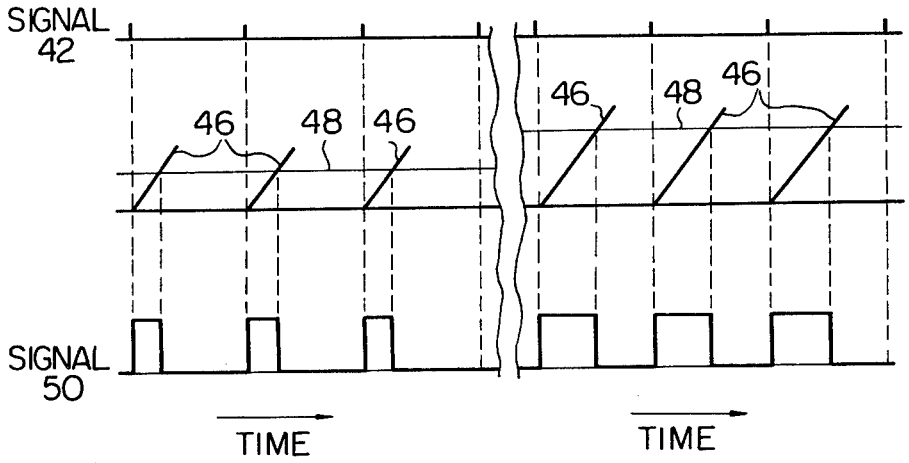
FIG. 4A and 4B are timing diagrams of signals from the control circuit shown in FIG. 3.
Figure 5:
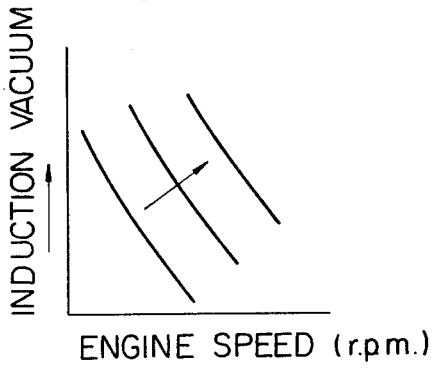
FIG. 5 is a graph showing the required admission of air through the additional intake port bore as a function of the engine speed and induction vacuum.

Referring to FIGS. 3 to 5, flow control device 13, which is diagrammatically shown in FIG. 1, will be described.

Going into the detail of flow control device 13, a flow control valve 30 is fluidly disposed in the conduit 25 (see FIG. 3). A vacuum servo 31 is mounted on the conduit 25 and has a diaphragm 31*a* to which the valve stem of the valve 30 is fixedly connected, an atmospheric chamber 31*b* below (viewing FIG. 3) the diaphragm 31*a*, a vacuum chamber 31*c* above (viewing FIG. 3) the diaphragm 31*a*, and a spring 31*d* mounted within the vacuum chamber 31*c* to act against the diaphragm 31*a* to bias the valve 30 to the illustrated closed position in which the conduit 25 is closed by the valve 30. A vacuum conduit 31*e* connects the outlet of a source of constant vacuum, in the form of a vacuum accumulator 32, to the vacuum chamber 31*c*. The vacuum accumulator 32 is connected to the source of the engine induction vacuum through a check valve 33. A pressure regulator 34 is mounted on the vacuum accumulator 32 to keep the pressure within the accumulator 32 constant irrespective of the engine operating conditions. The vacuum conduit 31*e* is provided with an orifice 35 therein and an air bleed conduit 36 has one end connected to the vacuum conduit 31*e* at a location intermediate the orifice 35 and the vacuum chamber 31*c*. An air bleed orifice 37 is provided within the air bleed conduit 36 at an opposite end thereof. A solenoid valve 38 is arranged to control flow through the air bleed conduit 36. When not energized, the solenoid valve 38 closes the air bleed conduit 37, while, when energized, it opens the air bleed conduit 36. A control circuit 40, only diagrammatically shown in FIG. 3, is electrically connected with the solenoid valve 38.

The control circuit 40 shown in FIG. 3 comprises a clock counter 41 which generates a reset signal 42 at regular intervals. The reset signal 42 is fed to an integrator 43 and also to a flip flop 44 to reset them. An electrical signal 45 representing the engine speed (the engine r.p.m.) is fed to the integrator 43. An output signal voltage 46 from the integrator 43 rises at a faster rate when the engine speed is high than when the engine speed is low. This output signal voltage 46 is fed to a comparator 47 to which a reference signal voltage 48 representing the engine induction vacuum is fed. The reference signal voltage 48 is higher when the engine induction vacuum is high, i.e., when engine load is low, than when the induction vacuum is low, i.e., when engine load is high. The comparator 47 feeds a reset signal 49 to the flip flop 44 when the signal 46 exceeds the signal 48. Since time period after the instance of the reset signal 42 to the instance of the reset signal 49 is variable in response to the engine speed and induction vacuum, the flip flop 44 will produce a pulse signal 50 having a pulse width variable in response to the engine speed and indication vacuum. This pulse signal 50 is amplified by means of an amplifier 51 and then used to energize the solenoid valve 38 so that the solenoid will be energized for a time corresponding to the pulse width.

FIG. 4A shows a timing diagram representing the condition that the engine speed is high and induction vacuum is low, while FIG. 4B shows a timing diagram representing the condition that the engine speed is low and induction vacuum is high. FIG. 5 shows a graph plotting the required amount of scavenging air for expelling the residual gas from a cylinder as against the engine speed and induction vacuum. It will now be understood that with the valve 30 the amount of scavenging air will be varied along the graph shown in FIG. 5.

In operation, an air pump 10 will transfer, under pressure, air toward additional intake port bore 9. When air inlet valve 4 opens during a period beginning at the end portion of the exhaust stroke and ending at the beginning portion of the intake stroke, air will be admitted, under pressure, into the cylinder to expel the residual gas from the cylinder through exhaust port bore 8.

Under partial load conditions when the engine induction vacuum is high enough to cause vacuum servo 19 (see FIG. 1) to urge the OMC valve 18 into the open position, exhaust gas recirculation will be effected. Then, a portion of exhaust gas will flow from exhaust conduit 7 toward air pump 10 upstream thereof to be conveyed by air flow toward additional intake port bore 9 and will be admitted into the cylinder together with air as air inlet valve 4 opens. Under these conditions, the flow rate of exhaust gas passing through EGR conduit 15 will vary in proportion to the exhaust pressure as explained before.

During idle and full load conditions, the OMC valve 18 fully closes EGR conduit 15 to prevent exhaust gas recirculation.

It will be noted that the rate or proportion of exhaust gas in combustion chamber 2 upon ignition will be kept substantially constant over partial load conditions suppressing NOx formation without imparing the stable engine operation under these conditions because the residual gas is forcibly expelled from cylinder and the amount of exhaust gas rated to the amount of charge in the cylinder is admitted into the cylinder.

It is recognized that stable engine operation is accomplished under idle condition because the admission of air to expel the residual gas from the cylinder enhances the combustion condition of the charge in the cylinder under this condition.

It is recognized that since, if required under full load conditions, a cylinder can be charged with more fuel because more fuel can be burned under the help of air having replaced the residual gas, causing an increase in the engine power output under full load conditions.

Referring to the timing of air inlet valve 4 and its valve lift, the opening of air inlet valve 4 is initiated during the exhaust stroke and terminated during the subsequent intake stroke and the valve lift as exhaust valve 5 is open shall be sufficiently high to admit enough air to forcibly expel the residual gas from the cylinder, while, the valve lift as intake valve 3 is open shall be low to provide sufficiently high inflow velocity of air to facilitate mixing of the air fuel mixture from intake port bore 6.

It is confirmed that swirling of air will facilitate mixing of the air fuel mixture from the intake port bore 6 and add to combustion speed, making stable engine operation possible on lean air fuel mixture. For this purpose, it is preferrable to impart force to inflowing air from additional intake port bore 9 such as by providing a valve shroud 4*a* as shown in FIG 2.

With this preferred valve arrangement shown in FIG. 2, stable combustion with lean air fuel mixture makes it possible to reduce fuel consumption with low NOx emission levels.

As shown in FIG. 2, a spark plug 55 and three valves 3, 4 and 5 are preferrably arranged such that there is produced a stratified charge comprising a localized combustible air fuel mixture cloud around the electrode of the spark plug 55. This arrangement will cause stable engine operation with far lower NOx emissions.

If with EGR system described in the preceding description, an appropriate amount of exhaust gas recirculation can not be obtained to accomplish the strict NOx emission level target, this can be accomplished by delaying the closing timing of air inlet valve 4, or alternatively by arranging, in addition to the EGR conduit 15, another EGR conduit leading from the exhaust conduit 7 to the engine intake system. In the latter case, the flow rate of exhaust gas passing through the additional EGR conduit may be roughly controlled with a simple control valve because the precise control is effected with the EGR system illustrated in FIG. 1.

It will now be appreciated as one advantage of an engine system of the invention that the amount of exhaust gas in the combustion chamber upon ignition has been kept appropriate with a simple EGR system without the need for a conventional complicated EGR control system.

It will also be appreciated that flow control orifice 17 may be eliminated if EGR conduit 15 is designed appropriately so as to insure the same amount of exhaust gas flow therethrough.

What is claimed is:

1. An engine system comprising:

a four stroke reciprocatory internal combustion engine which has a cylinder block formed with at least one cylinder; a piston slidably disposed in said cylinder for reciprocal movement therein; a cylinder head secured to said cylinder block to close said cylinder, said cylinder, piston, and cylinder head cooperating to form a combustion chamber; an intake means, including a carburetor, for admitting air fuel mixture into said cylinder during the intake stroke of said piston; an exhaust means for discharging the exhaust gas resulting from the combustion of the air fuel mixture from said cylinder during the exhaust stroke of said piston; and an additional intake means for admitting air, under pressure above atmospheric pressure, into said cylinder during a period overlapping the exhaust stroke of said piston and during a period overlapping the intake stroke of said piston; and an exhaust gas recirculation conduit leading from said exhaust means to said additional intake means to permit a portion of exhaust gas passing through said exhaust means to flow from said exhaust means toward said cylinder through said additional intake means.

2. An engine system as claimed in claim 1, in which a flow control orifice is arranged within said exhaust gas recirculation conduit.

3. An engine system as claimed in claim 1, in which operation mode control means is provided for effecting exhaust gas recirculation through said exhaust gas recirculation conduit under part load conditions of said reciprocatory internal combustion engine only.

4. An engine system as claimed in claim 3, in which said operation mode control means comprises a valve fluidly disposed in said exhaust gas recirculation conduit, a spring means for urging said value to fully close said exhaust gas recirculation conduit, and a vacuum servo means for urging said valve to fully open said exhaust gas recirculation conduit in response to a vacuum within said carburetor at a vacuum port disposed on the atmosphere side of the carburetor throttle valve when said carburetor throttle valve is at idle speed position.

* * * * *